United States Patent [19]

Andrews

[11] Patent Number: 5,059,281

[45] Date of Patent: Oct. 22, 1991

[54] PROCESS AND MECHANISM TO EMPTY PULPING DIGESTER

[75] Inventor: Ethan K. Andrews, Lenox, Mass.

[73] Assignee: Beloit Corporation, Beloit, Wis.

[21] Appl. No.: 412,079

[22] Filed: Sep. 25, 1989

[51] Int. Cl.[5] ..... D21C 7/08

[52] U.S. Cl. ..... 162/52; 162/57; 162/246

[58] Field of Search ..... 162/52, 246, 57, 237, 162/238

[56] References Cited

U.S. PATENT DOCUMENTS

| | | | |
|---|---|---|---|
| 953,076 | 3/1910 | Waite | 162/52 |
| 1,947,888 | 2/1934 | Thorne | 162/246 |
| 3,741,864 | 6/1973 | Pennington | 162/246 |
| 4,039,373 | 8/1977 | Michelsen | 162/246 |
| 4,284,120 | 8/1981 | Glöersen | 162/237 |

*Primary Examiner*—Richard V. Fisher
*Assistant Examiner*—Brenda A. Lamb
*Attorney, Agent, or Firm*—Dirk J. Veneman; Raymond W. Campbell

[57] ABSTRACT

A batch process and mechanism for cooking fibrous paper pulb including a digester wherein the pulp is cooked under elevated temperatures and pressures for a predetermined time, a discharge line leading from the lower end of the digester to a blow tank, a valve in the discharge line and cycling means connected to the valve cyclically opening and closing the valve while the contents are emptied from the digester.

18 Claims, 1 Drawing Sheet

PROCESS AND MECHANISM TO EMPTY PULPING DIGESTER

BACKGROUND OF THE INVENTION

This invention relates to improvements in art of digestion of cellulosic material such as wood chips, and more particularly to a process and apparatus for removing the delignified chips from a digester at the completion of cooking.

In a conventional batch process for digesting wood chips, a digester is filled with chips and is charged with cooking chemicals. The digester is then sealed, and the temperature and pressure of the digester are elevated to desired cooking conditions. Elevated temperature and pressure are maintained for a cooking time period to achieve the desired delignification. During the cooking time, the cooking liquors may be circulated through the digester. At the conclusion of the cook, a blow valve at the bottom of the digester is opened, and the contents of the digester is discharged into a blow tank.

One common way of blowing the contents of a conventional batch digester is to open the blow valve leading from the bottom of the digester and leave it open, thereby permitting the liquor in the digester which is at an elevated temperature and pressure to flash into steam at the top of the digester and force the contents out of the digester.

In certain modifications to the conventional batch cooking process, the conventional blow technique utilizing liquor flashing to force the contents from the digester can not be used. For example, in one modification to the batch cooking process, displacement fluids, which may be fluids from subsequent washing or other process stages, are used to displace the cooking liquor from the digester before the digester is emptied. In this modification, the cooking liquors are displaced bottom to top substantially at cooking temperature and pressure, so that the heat energy contained in the cooking liquors can be utilized subsequently. The displacement liquors are at lower temperature than the cooking liquors so that, after displacement is complete, the contents of the digester, including delignified chips and the displacement liquors, are at temperatures substantially less than cooking temperature. In some such modifications, flashing may not occur or may be insufficient to empty the digester.

It is common in such modified batch cooking processes to utilize a fluid pumped into the top of the digester to force the digester contents through the blow valve at the bottom of the digester. The fluid pumped into the top may be a liquid, pressurized steam or air. In yet a further modification, pumps are used to remove the contents of the digester through the blow valve. In all of these modifications, the practice has been to open the blow valve and leave it open until the digester is emptied.

Certain results have been experienced in blowing digesters utilizing the established practices of leaving the blow valve open, which, although undesirable, were believed to be inherent and unavoidable from the blow techniques used. For example, when air is used as the medium for effecting blow, foaming tendencies increase and sulfur-containing gaseous emissions may be higher than allowable standards. Each of these "side effects" is now believed to be the result of air entrainment in the digester contents, inherently resulting from the air blow. Procedures and apparatus used to compensate for these undesirable results, such as the use of antifoaming chemicals, and emissions control systems are, in some instances, quite expensive. Often the compensating procedures or apparatuses also have undesirable side effects, which are believed to be unavoidably necessary.

Effects on the pulp have also been experienced when other fluids are used to blow digesters. For example, variations in the stock consistency have been experienced. After only several minutes of conventional blow procedures, the stock leaving the digester becomes slushy and foamy, due to fluid entrainment. The later volumes of stock are found to be much more dilute than earlier volumes of stock. Dilution of the digester contents by the blowing medium necessitates the use of large volumes of fluid medium for emptying the digester, which again, though undesirable, has been deemed inherent to and necessitated by the blow techniques utilized.

Yet another phenomena experienced in emptying digesters, particularly in modified batch processes, is that the digester empties inconsistently. During some blows, a substantial volume of the digester contents will remain in the digester. This has necessitated the incorporation of shower mechanisms in the bottom of the digester to wash the digester contents from the sides of the bottom of the digester, further diluting the stock. Again, the remedy to this undesirable result has been one of compensation, rather than correction of the result itself. The incomplete blows were viewed as an inherent, unavoidable problem resulting from the blow technique, and compensation was accomplished at not insignificant expense.

SUMMARY OF THE INVENTION

An analysis of the problems experienced during various blow techniques, including those referred to above, lead to an hypothesis that a vortex is generated in the digester and blow pipe during a blow. The vortex, extending from the top of the digester contents throughout the digester to the blow pipe, is believed to permit the blow fluid medium to mix with the digester contents and escape from the digester. This would seem to be confirmed by test results which indicated the necessity for using one and one-half to two times the digester volume to force the digester contents out of the digester. Clearly, the blow fluid medium passes from the digester with the digester contents, since a perfect displacement of the contents by the blow medium would require only 1.0 times the digester volume for such displacement. This hypothesis also explains the phenomena of foaming and stock dilution which have been observed.

An hypothesis has been formulated as to the cause of such vortex generation. It is believed that the creation of a vortex is due to the resultant force which occurs within the digester during the blow while the blow valve is open. It is believed that a horizontal force occurs due to centrifugal action perpendicular to the side wall of the digester, and that a vertical force occurs due to gravity and the digester overpressure which act axially, parallel to the side wall. The resultant force from the two component forces is one which generates a vortex. The vortex is believed to initially act to peel the stock off the side wall, but later, as the level of stock in the digester decreases, the vortex acts essentially to pin the stock against the digester bottom and side wall, thereby inhibiting discharge. Optimally, the stock should be discharged as plug flow, wherein the entire body of stock moves downwardly, with the upper surface being forced downwardly uniformly by the pressurized fluid above the stock. The vortex, which is believed to be generated, has a tendency to break through the stock, allowing the fluid used for the blow to advance through the contents and out the blow line long before the digester is empty.

Accordingly, an object of the present invention is to provide an improved method and apparatus for blowing stock from a digester at the end of the cooking process wherein the creation of a vortex is defeated and a uniform plug discharge is accomplished.

A further object is to provide an improved apparatus and method for emptying a digester wherein blow fluid entrainment in the digester contents is minimized, and wherein very low sulfur-containing gaseous emissions result.

A further object of the invention is to provide an improved method and apparatus for discharging a digester at the end of the cooking process wherein improved productivity results, and more uniform consistency of the stock blown from the digester to the blow tank is experienced.

Yet another object of the present invention is to provide an improved method and apparatus for discharging a digester at the end of the cooking process which can be utilized to eliminate many of the problems experienced in a wide variety of digester blow techniques, and which reduces the volume of fluid necessary for emptying the digester contents.

Another object of the present invention is to provide an improved method and apparatus for discharging a digester at the end of the cooking process which can be performed after minimal equipment retrofit on existing digesters, without substantial modification to the digester system, and which does not substantially extend the time necessary for emptying a digester, as compared with previously used digester discharge methods.

In accordance with the invention, using short cycles in blowing the digester contents is believed to eliminate vortex generation and reduces, or eliminates, many problems heretofore believed unavoidable. By providing a cycling means for the blow valve in the discharge line from the digester, for opening and closing the blow valve, and by controlling the opening and closing cycle, the vortex phenomena may begin slowly at the time when the valve is open, but will decay rapidly during the closed cycle of the valve, before the undesirable results occur. Upon reopening of the valve, plug flow from the digester continues. The intermittent opening and closing of the blow valve defeats the vortex formation and results in continuous plug flow. Optimally, the cycling is performed by equal open and close times of the valve, but variations can be made dependent on the various factors involved, such as the type of fluid and fluid pressure used to blow the digester contents, the size of the digester, the condition of digester contents, and other operational factors.

Other objects, advantages, and features will become more apparent with the teaching of the principles of the invention in connection with the disclosure of the preferred embodiments thereof in the specification, claims, and drawings, in which:

DETAILED DESCRIPTION OF THE PREFERRED EMBODIMENTS

Figure 2:
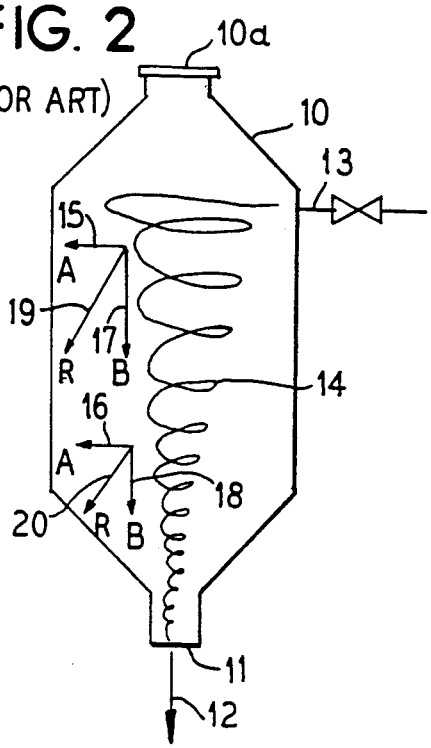
FIG. 2 (PRIOR ART)
FIG. 2 is another schematic illustration similar to FIG. 1, but illustrating the prior art and the forces believed to be operative therein.

Referring now more specifically to the drawings, FIG. 2 illustrates a digester 10 of the prior art which, during a cooking operation, is loaded with chips through a top opening 10*a* and sealed. The cooking process is begun by admitting cooking liquor through suitable lines, not shown, and elevating the temperature and pressure by heating means, not shown. The elevated temperature and pressure, often with liquor recirculation, are maintained until the desired degree of delignification has been achieved. After completion of the cooking process, the contents of the digester is blown downwardly through opening 11 at the bottom of the digester. The blow line is schematically illustrated by arrow 12, and leads to an atmospheric blow tank. While the contents may be blown by the release of pressure causing the heated liquor to flash into steam to apply a downward pressure to the top surface of the chips, as in conventional blow methods, additional fluid under pressure may be added through line 13 to force the contents of the digester downwardly. This fluid may be in the form of pressurized steam, pressurized air or other non-condensible gas, or fluids such as washer filtrate, spent liquors and the like. The fluid may be other fluid nascent to the digester system.

It has been found that, by keeping the blow valve open, initially plug flow is experienced through the blow line; however, after a short period of time into the blow cycle, the stock exiting the digester becomes slushy and foamy, indicating a break through due to gradual vortex formation as illustrated by the diagrammatic vortex line 14. The consistency of the stock flowing from the blow line varies significantly, and the problems relating to sulfur-containing gaseous emissions are experienced. The blow may or may not be complete.

Within the digester 10, the vortex is believed to be formed by the force resulting from the horizontal and vertical force components experienced during continued blow of the stock contents. The horizontal forces "A" occurring in the digester are indicated by the vector identified by numeral 15 at the upper end of the digester, and at the lower end of the digester by the vector identified by numeral 16 in FIG. 2. The horizontal forces shown at "A" are due to the centrifugal action which tends to react perpendicular to the side wall. The vertical forces "B" occur due to gravity and overpressure, and act axial in the digester, parallel to the side wall. The vertical force component "B" is identified by numeral 17 in the vector diagram at the top of the digester and by numeral 18 in the vector diagram at the bottom of the digester shown in FIG. 2. The resultant force "R", which is the result of combined forces "A" and "B", is felt by the stock as an outward and downward force, and tends to generate a vortex. The resultant force "R" is identified by numeral 19 in the vector diagram at the top of the digester and by numeral 20 in the vector diagram at the bottom of the digester shown in FIG. 2.

The initial condition of the resultant force acts to peel off the stock and carry it toward the blow line; however, as the vortex continues to form and intensify, the vortex penetrates the center of the body of the stock. This opens a path to the blow line for the fluid used to force out the digester contents. Entrainment of blow fluid in digester contents occurs, resulting in large consistency variations in the pulp entering the blow tank, causing a large volume of liquor and blow fluid to pass to the blow tank. A larger amount of displacement fluid is needed for the blow, and an increase in blow cycle time results.

Figure 1:
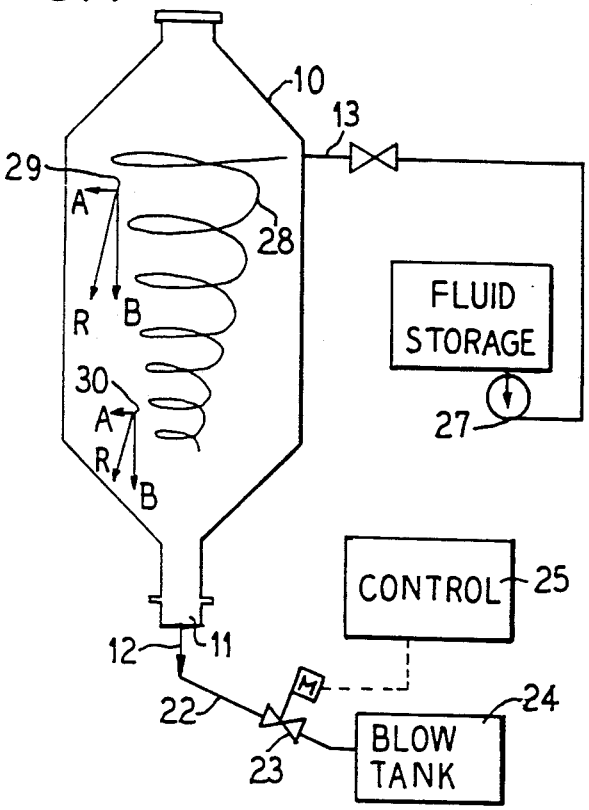
FIG. 1 is a schematic, vertical view of a digester, illustrating an arrangement for cyclic blowing in accordance with the present invention, and illustrating the forces in the digester believed to be active.

It has been discovered, as illustrated in the arrangement of FIG. 1, that the intermittent closure and subsequent reopening of a blow valve will cause a rapid decay of the vortex being generated, and will result in true plug flow at all times that pulp is discharged from the digester As illustrated in FIG. 1, the digester 10 has a blow opening 11 to which is connected a blow line illustrated by the arrow 12, and a line 22 connected to a blow tank 24. A blow valve 23 is in the line 22 and is maintained closed during the cooking cycle. A control apparatus 25 is connected to the valve, and is capable of controllably cycling the valve 23 to open and closed positions.

For aiding in the blow, a fluid pressure supply 13 may be connected to the upper end of the digester and is supplied by a motive force apparatus, such as a pump or compressor 27, so that the blow fluid may be pressurized.

Within the digester is shown a vortex pattern 28, which initially generates slowly during the open period of the valve and is believed to be caused by forces on the stock illustrated by the vector diagrams 29 and 30. Force "A" of the diagram is the horizontal force, and force "B" of the diagram is the vertical force, with force "R" being the resultant thereof.

It has been discovered that, upon the initial opening of the valve 23, plug flow is experienced through the blow line, until vortex generation causes complete break through, interrupting the plug flow. However, closure of the blow valve will cause a rapid decay of the force "A", and will cause a modest, instantaneous reduction of force "B". As the resultant force "R" decays, it sweeps toward the component force "B". In the lower portions of the digester, this results in the fiber impinged on the side wall sections of the lower cone portion to be swept toward the opening 11 and discharged a plug flow when the valve 23 again opens.

This theoretical, working hypothesis represents what I believe to be an explanation, oversimplified, of the cause-and-effect phenomena of why pulping digesters experience many of the undesirable results when blown in accordance with accepted prior practice, such as how air is entrained in the stock as it enters the blow tank. It also explains how the step of cyclically closing and opening the valve has been found to be a means for inhibiting the undesirable effects previously experienced.

With cyclic opening and closing of the valve 23, the vortex effect is minimized, or essentially eliminated, so that plug flow occurs in the discharge of the cooked pulp to the blow tank, through out the entire blow cycle. Various employment concepts of the method and apparatus shown in FIG. 1 have been utilized. In one arrangement, the cycle has been to open and close the blow valve 23 for one minute intervals, with the valve first being opened for one minute, and then closed for one minute. The cycle thus includes equal periods of opening time and closed time until the digester is emptied. The actual time required for opening or closing the valve may vary depending on the type of valve and actuator used.

Another arrangement which has been found to be successful is to open the valve for initial blowing until one-third of the digester is emptied, and to thereafter close the valve for a period. The valve is again opened until one-half of the remaining two-thirds is blown, at which time the valve is again closed. The final one-third volume of the digester is blown after opening the valve for a third time.

In still another advantageous method for practicing the present invention, the blow valve is gradually opened until it reaches a fully-open state at which time operation of the actuator for the valve is reversed to begin gradually closing the valve. Upon reaching the fully-closed position, the actuator is again immediately reversed to begin opening the valve. In this manner, flow from the digester to the blow pit remains essentially continuous throughout the blowing cycle. As a modification to this process, the valve may be maintained in its open position for a period of time before closing commences.

The time period in which the valve can be maintained open will vary depending upon the type of valve used, the actuator used, the condition of the contents in the digester, and the structure of the blow line, the digester, and other related equipment. In this regard, the optimal cycle vary from digester to digester, and may include equal periods of open and closed time, open times longer than closed times, closed times longer than open times, and equal or different cycle times from the open to the closed and from the closed to the open positions. However, in optimizing the present invention for various digesting systems, the goal is to control the flow from the digester such that vortex formation in the digester is eliminated or minimized, so that break through to the outlet by the vortex does not occur.

The concept of the present invention will apply whether the pressure for blowing the digester, which is applied at the top of the digester, is derived from the pressurized cooking liquor or other fluid, or from steam injected into the digester or by pressurized air or other gas added to the top of the digester.

Figure 3:
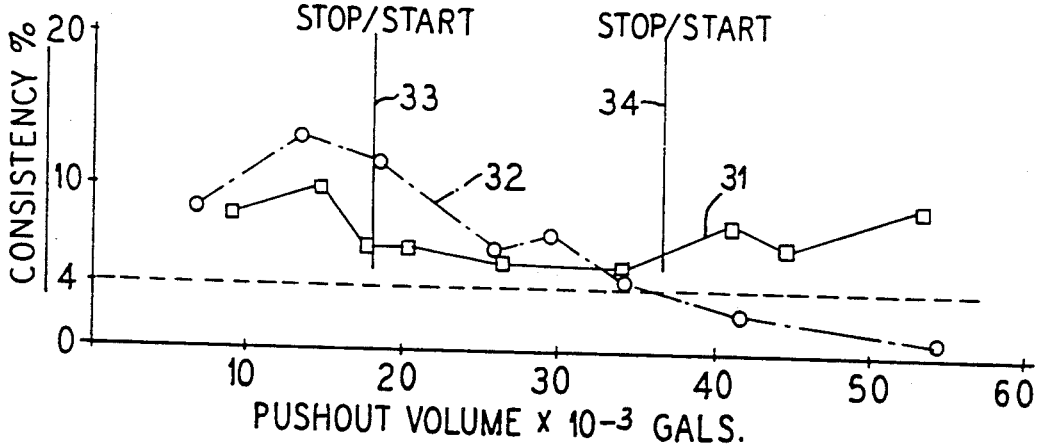
FIG. 3 is a graph illustrating comparative operation between the prior art and the present method and resultant consistency improvement achieved in the present inventions.

FIG. 3 illustrates the improved uniformity of pulp consistency which has been found to result from the present invention, as compared to conventional blow techniques. The graph shown therein has been plotted from test runs, and the line 31 show an intermittent blow according to the present invention. The vertical lines 33 and 34 show the stop-start process where the valve is closed and reopened. The consistency measurement from a conventional blow wherein the blow valve remains open through out the entire blow is plotted by the broken line identified by numeral 32. The chart illustrates that consistency variations when the blow valve is cycled open and closed are much less than the variations experienced when the digester is blown by conventional techniques.

Thus, it will be seen that I have provided an improved method and apparatus for improving the overall performance of digesters, and particularly for improved blow-down of the digester which achieves the objectives above set forth.

I claim:

1. In a batch process of preparing pulp for papermaking, the steps comprising:

cooking a batch of pulp in a closed digester under elevated temperatures and pressure;

supplying a fluid under pressure into the digester at the top of the digester at the end of the cooking process to empty the batch of pulp from the digester through a pulp outlet;

and cyclically opening or closing the pulp outlet while pulp passes therethrough, whereby vortex generation within the digester is prevented.

2. In the process of preparing pulp for papermaking, the steps in accordance with claim 1:

wherein said cyclically opening and closing the pulp outlet includes holding the outlet open and closed for equal periods of time.

3. In the process of preparing pulp for papermaking, the steps in accordance with claim 1:

wherein said cyclically opening and closing the pulp outlet is performed by alternately holding the outlet open for one minute and holding the outlet closed for one minute, in a cyclic operation until the digester has been emptied.

4. In the process of preparing pulp for papermaking, the steps in accordance with claim 1:

wherein the said cyclically opening and closing the pulp outlet for a period of time until approximately one-third of the contents have been emptied from the digester, and thereafter closing the pulp outlet, and again opening the outlet from the discharge of the remaining two-thirds of the digester contents.

5. In the process for preparing pulp for papermaking, the steps in accordance with claim 1:

wherein the said cyclically opening and closing the outlet includes holding the valve in an open position for a period of time longer than the closed position in each cycle.

6. In the process for preparing pulp for papermaking, the steps in accordance with claim 1:

wherein the said cyclically opening and closing the pulp outlet includes holding the outlet open for a period of time shorter than holding the opening closed during each cycle.

7. In the process for preparing pulp for papermaking, the steps in accordance with claim 1:

wherein the said cyclically opening and closing the pulp outlet includes opening the valve over a period of time from a closed position to a fully-open position, and substantially immediately reversing the operation of the valve from a closed position to an open position, upon reaching the fully-open position.

8. In the process for preparing pulp for papermaking, the steps in accordance with claim 7:

wherein the said cyclically closing and opening the pulp outlet includes closing the valve over a period of time from an open position to a fully-closed position, and substantially immediately reversing the operation of the valve from an open position to a closed position, upon reaching the fully-closed position.

9. In the process for preparing pulp for papermaking, the steps in accordance with claim 1:

wherein the said cyclically closing and opening the pulp outlet includes closing the valve over a period of time from an open position to a fully-closed position, and substantially immediately reversing the operation of the valve from an open position to a closed position, upon reaching the fully-closed position.

10. A digester mechanism for cooking fibrous paper pulp, comprising in combination:

a closed pulp digester for cooking pulp and having a discharge line leading from the lower end of the digester for blowing the contents;

means for supplying pressurized fluid at the upper end of the digester for blowing the contents of the digester at the termination of a cooking cycle;

a blow valve in the discharge line;

and cycling means connected to said blow valve for cyclically opening and closing the blow valve so that the pulp contents are blown through the discharge line when the valve is opened and vortex generation within the digester is retarded by closing the valve.

11. A digester mechanism for cooking fibrous paper pulp constructed in accordance with claim 10:

wherein the cycling means opens and closes the valve for equal periods of time.

12. A digester mechanism for cooking fibrous paper pulp constructed in accordance with claim 10:

wherein the cycling means opens the valve for a period of substantially one minute and closes the valve for a period of substantially one minute in a repeated cycle.

13. A digester mechanism for cooking fibrous paper pulp constructed in accordance with claim 10:

wherein the cycling means opens the valve for a period of time until substantially one-third of the digester has been emptied, and again closes the valve, and reopens the valve for a period until the remaining two-thirds of the digester has emptied.

14. A digester mechanism for cooking fibrous paper pulp constructed in accordance with claim 10:

wherein said means for supplying fluid includes a supply source of fluid nascent to the digester mechanism.

15. A digester mechanism for cooking fibrous paper pulp constructed in accordance with claim 10:

wherein said means for supplying fluid includes a supply source of liquid.

16. A digester mechanism for cooking fibrous paper pulp constructed in accordance with claim 10:

wherein said means for supplying fluid includes a supply source of steam.

17. A digester mechanism for cooking fibrous paper pulp constructed in accordance with claim 16:

wherein said supply source of steam is flash steam generated by a release of digester pressure.

18. A digester mechanism for cooking fibrous paper pulp constructed in accordance with claim 10:

wherein said means for supplying fluid includes a supply source of non-condensible gas.

* * * * *